US011834817B2

(12) United States Patent
Brown

(10) Patent No.: US 11,834,817 B2
(45) Date of Patent: Dec. 5, 2023

(54) INFLATABLE SINK DEVICE

(71) Applicant: Bruce Brown, Canton, MS (US)

(72) Inventor: Bruce Brown, Canton, MS (US)

( * ) Notice: Subject to any disclaimer, the term of this patent is extended or adjusted under 35 U.S.C. 154(b) by 0 days.

(21) Appl. No.: 17/696,961

(22) Filed: Mar. 17, 2022

(65) Prior Publication Data

US 2022/0307247 A1 Sep. 29, 2022

Related U.S. Application Data

(60) Provisional application No. 63/165,981, filed on Mar. 25, 2021.

(51) Int. Cl.

| | |
|---|---|
| ***E03C 1/18*** | (2006.01) |
| ***E03C 1/32*** | (2006.01) |
| ***A47K 1/02*** | (2006.01) |
| ***A47K 3/06*** | (2006.01) |

(52) U.S. Cl.

CPC ..... *E03C 1/18* (2013.01); *A47K 1/02* (2013.01); *A47K 3/06* (2013.01); *E03C 1/32* (2013.01)

(58) Field of Classification Search

CPC .. A47K 1/02; A47K 3/06; A47K 3/062; E03C 1/14; E03C 1/16; E03C 1/18; A61G 7/0005; B60R 15/02; A45D 19/04; A45D 19/06; A45D 19/08; A45D 19/10; A45D 19/12

See application file for complete search history.

(56) References Cited

U.S. PATENT DOCUMENTS

| | | | | |
|---|---|---|---|---|
| 3,013,280 | A * | 12/1961 | Coffman | A45D 19/04 4/516 |
| 5,465,438 | A * | 11/1995 | Allman | A47K 1/02 4/640 |
| 8,621,682 | B2 * | 1/2014 | Maximilien | E03D 5/00 4/625 |
| 10,251,458 | B1 * | 4/2019 | Weiss | A45D 44/02 |
| 11,219,337 | B1 * | 1/2022 | Austin | A47K 1/02 |
| 2004/0040083 | A1 * | 3/2004 | Bentley | A47K 3/06 4/585 |
| 2020/0199858 | A1 * | 6/2020 | Eilmus | E03C 1/182 |

FOREIGN PATENT DOCUMENTS

| | | | | |
|---|---|---|---|---|
| DE | 202004010027 | U1 * | 11/2004 | A47K 1/02 |
| DE | 102008030899 | A1 * | 12/2009 | A47K 1/02 |
| JP | H08275993 | A * | 10/1996 | |
| WO | WO-2006115404 | A1 * | 11/2006 | A47K 3/024 |

* cited by examiner

*Primary Examiner* — Erin Deery
(74) *Attorney, Agent, or Firm* — Brennan, Manna & Diamond, LLC

(57) ABSTRACT

The present invention relates generally to the field of sinks. More specifically, the present invention relates to an inflatable sink device that is comprised of a body, further primarily comprised of a top tank, a bottom tank, a sink basin, an air pump, a battery, a water pump, and a faucet. The body further preferably resembles a bathroom vanity and is flexible or semi-flexible such that it can inflate with air to be used, or deflate for easier transportation and storage. The device also provides clean running water to be used for washing in a sink basin and a bottom tank that collects the resultant dirty water after use. In this manner, the device can be used in any place such that even without a traditional bathroom sink available, washing can still be accomplished within a stream of running water out of a faucet.

16 Claims, 5 Drawing Sheets

INFLATABLE SINK DEVICE

CROSS-REFERENCE TO RELATED APPLICATION

The present application claims priority to, and the benefit of, U.S. Provisional Application No. 63/165,981, which was filed on Mar. 25, 2021, and is incorporated herein by reference in its entirety.

FIELD OF THE INVENTION

The present invention relates generally to the field of sinks. More specifically, the present invention relates to an inflatable sink device that is comprised of a body further primarily comprised of a top tank, a bottom tank, a sink basin, an air pump, a battery, a water pump, and a faucet. The body further preferably resembles a bathroom vanity and is flexible or semi-flexible such that it can inflate with air to be used or deflate for easier transportation and storage. The device also provides clean running water to be used for washing in a sink basin and a bottom tank that collects the resultant dirty water after use. In this manner, the device can be used in any place, such that even without a traditional bathroom sink available, washing can still be accomplished within a stream of running water out of a faucet. Accordingly, the present disclosure makes specific reference thereto. Nonetheless, it is to be appreciated that aspects of the present invention are also equally applicable to other like applications, devices and methods of manufacture.

BACKGROUND

A household sink is an extremely practical invention used by millions of people every day. However, many activities occur away from a home or a properly functioning bathroom, such as long road trips, camping trips, days at the park, tailgating, etc. Said locations may further be without a place to wash hands of dirt, mud, and other substances accumulated on one's hands. Transporting a functioning sink as thought of today may be nearly impossible, and potentially unusable, even if transported. Instead, individuals may simply wash their hands by pouring a bottle of water over their hands. However, this is wasteful of clean water, especially if in an area where clean water is hard to come by. In addition, during this process, a person may be forced to use a lesser amount of water than what is needed to properly clean their hands due to limited bottled water supply.

Therefore, there exists a long-felt need in the art for an inflatable sink device. There also exists a long-felt need in the art for an inflatable sink device that can be easily inflated and deflated such that it does not require much storage space and can be easily transported. Further, there exists a long-felt need in the art for an inflatable sink device that accommodates handwashing and other tasks performed in a sink at any place or environment in which a traditional sink may not be available. In addition, there exists a long-felt need in the art for an inflatable sink device that separates the clean water used for handwashing from the resultant dirty water.

The subject matter disclosed and claimed herein, in one embodiment thereof, comprises an inflatable sink device. The device is primarily comprised of a body further primarily comprised of a top tank, a bottom tank, a sink basin, an air pump, a battery, a water pump, and a faucet. The body further preferably resembles a vanity and is flexible or semi-flexible such that it can inflate with air to be used or deflate for easier transportation and storage. The device also provides clean running water to be used for washing in a sink basin and a bottom tank that collects the resultant dirty water after use. In this manner, the device can be used in any place such that even without a traditional bathroom sink available, washing can still be accomplished within a stream of running water out of a faucet.

In this manner, the inflatable sink device of the present invention accomplishes all the forgoing objectives and provides a means to wash one's hands in a place where a traditional bathroom sink is inaccessible. Further, the device inflates with air such that when not in use, it takes up little space, allowing the device to be easily transported and stored. In addition, the device separates the clean water from the dirty water that results after handwashing, allowing a user to clean their hands when away from the home.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an inflatable sink device. The present invention relates to an inflatable sink device. The device is primarily comprised of a body, further primarily comprised of a top tank, a bottom tank, a sink basin, an air pump, a battery, a water pump, and a faucet. In differing embodiments, the body may have the appearance of a plurality of differing types of sinks. The body may also be made of a plurality of materials, such as rubber, commonly used for making inflatable objects. However, the body is preferably made of a flexible or semi-flexible plastic material. In addition, any surface of the body may be comprised of a plurality of indicia such as patterns, logos, emblems, images, symbols, designs, letters, words, characters, animals, advertisements, brands, etc.

The body also has a generally rectangular shape, once inflated, comprised of four side surfaces, a bottom surface, and a top surface. Attached to one of the side surfaces may be a paper towel holder and the bottom surface may be a different material than the rest of the body or textured to provide additional grip and stability. The top surface is further comprised of at least one storage openings, at least one sink basin with a drain hole, and an external male fitting. The sink basin collects water as it empties from a faucet that is additionally on the top surface and funnels it through the drain hole. The faucet is comprised of a shutoff valve that, when turned open, allows water to expel from the faucet and into the sink basin. The external male fitting connects to the female end of a hose such that water may be input into the device. The other end of the hose may attach to a water container. By lifting and tipping the water container, water in the water container travels through the hose and into a top tank of the device.

The device is comprised of two storage tanks, a top tank and a bottom tank. The top tank holds clean water from the water container to be used for washing, whereas the bottom tank collects the dirty water that results from washing. When the shutoff valve of the faucet is opened, a water pump pushes water from the top tank, through a water pump tubing, and out of the faucet. The water then funnels down the drain hole of the sink basin and through a main drain tube that passes through the top tank and expels into the bottom tank. Each tank is comprised of a main drain tube that extends out through a side surface of the device. A shutoff valve is present on each main drain line of each tank that, when closed, prevents the water from expelling from each tank.

A control panel on a side surface of the body operates the electrical components of the device. The control panel is comprised of at least one button that either collectively or individually controls each component. An air pump may be used to inflate or deflate the device and may be controlled using the control panel. Additionally, the water pump that pushes water from the top tank and through the faucet is also controlled by the control panel. A battery also powers both the water and air pumps as well as the control panel itself. To transport and store the device, the air pump may deflate the body, allowing it to be folded compactly such that it can easily fit into a carrying bag. The hose and water container may also fit into the carrying bag such that all components of the device may be transported or stored in the carrying bag.

Accordingly, the inflatable sink device of the present invention is particularly advantageous as it provides a means to wash one's hands where a traditional bathroom sink is inaccessible. Further, the device separates clean water used for washing from the dirty water that results after washing. In addition, the device may be inflated and deflated with air such that it may be folded compactly to allow for simple storage and transportation means. In this manner, the inflatable sink device overcomes the limitations of existing sink devices known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
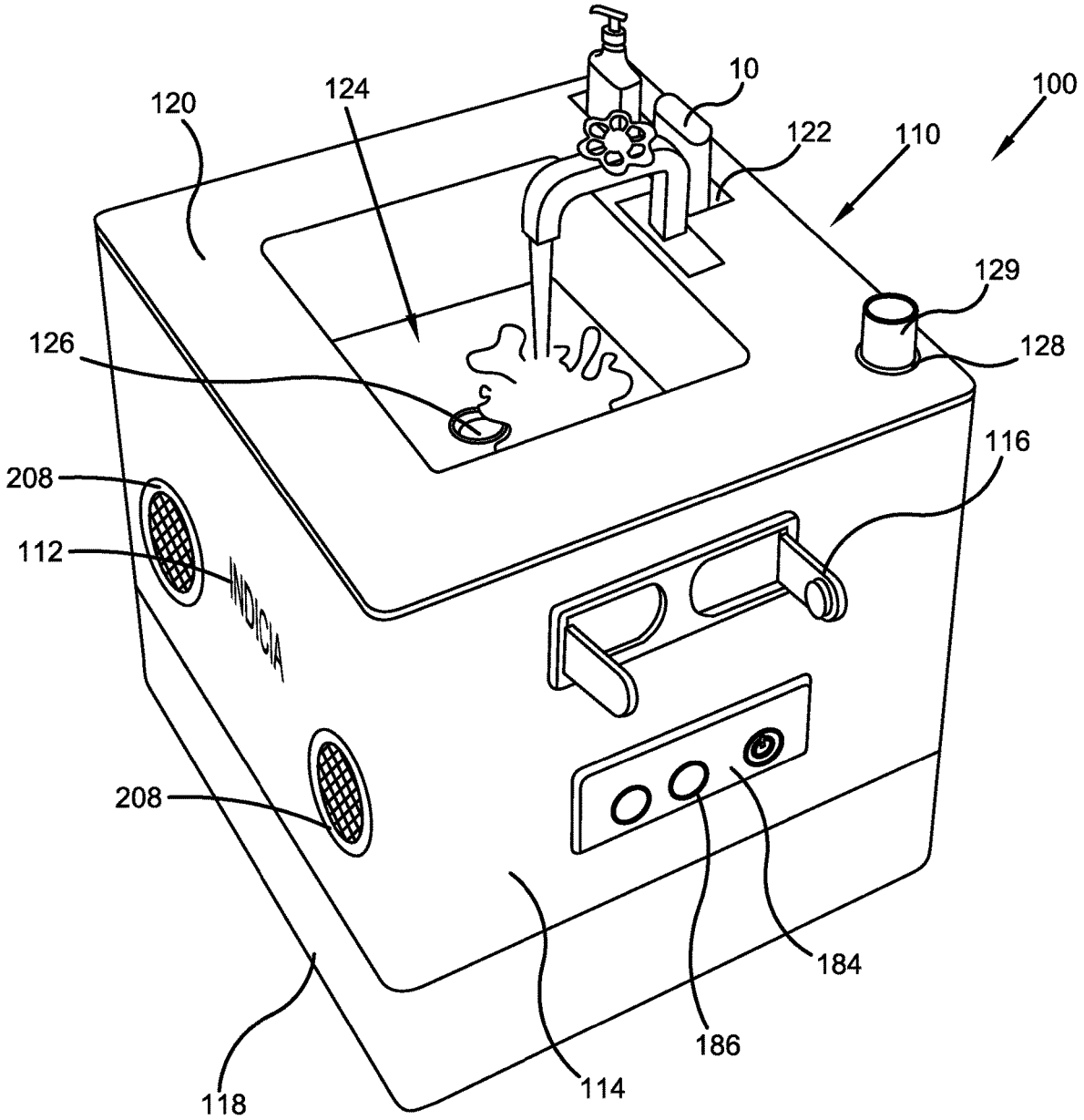
FIG. 1 illustrates a perspective view of one potential embodiment of an inflatable sink device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an inflatable sink device. There also exists a long-felt need in the art for an inflatable sink device that can be easily inflated and deflated such that it does not require much storage space and can be easily transported. Further, there exists a long-felt need in the art for an inflatable sink device that accommodates handwashing and other tasks performed in a sink at any place or environment in which a traditional sink may not be available. In addition, there exists a long-felt need in the art for an inflatable sink device that separates the clean water used for handwashing from the resultant dirty water.

The present invention, in one exemplary embodiment, is comprised of an inflatable sink device that allows a person to wash their hands in a place where a traditional bathroom sink is unavailable or inaccessible. The device is primarily comprised of a body, further primarily comprised of a top tank, a bottom tank, a sink basin, an air pump, a water pump, and a faucet. In differing embodiments, the body may have the appearance of a plurality of differing types of sinks. The body may also be made of a plurality of materials commonly used for inflatable objects such as a rubber, but may also be made of a flexible or semi-flexible plastic material. In addition, any surface of the body may be comprised of a plurality of indicia such as patterns, logos, emblems, images, symbols, designs, letters, words, characters, animals, advertisements, brands, etc.

The body, once inflated, has a generally rectangular shape comprised of four side surfaces, a bottom surface, and a top surface. A paper towel holder may be attached to a side surface of the body, preferably within reach of a person washing their hands. The paper towel holder may simply compress the paper towel tubing or retain the paper towel roll in some other way. The bottom surface of the body may be textured or made of a differing material than the remainder of the body to provide better grip to the ground or other surface on which the device is resting. The top surface of the body is further comprised of at least one storage openings, at least one sink basin with a drain hole, an external male fitting, and a cap. The storage openings may be used to hold items such as, but not limited to, a sponge, a soap dispenser, a bar of soap, dishwashing liquid, etc. The sink basin collects water that exits from a faucet and funnels it down through the drain hole. A shutoff valve of the faucet may be turned in one direction to emit water from the faucet and turned in the opposite direction to prevent water from emitting from the faucet. The external male fitting allows a hose with a female fitting to attach to the device and fill it with water. When a hose is not attached to the external male fitting, a cap with a female fitting may be attached to the external male fitting to prevent any backflow leaks or other materials from entering the device.

The device is further comprised of two storage tanks, a top tank and a bottom tank. The top tank is used to hold clean water that is used for washing the hands of a user. The clean water enters the top tank through the external male fitting of the top surface of the body. To drain the top tank, a main drain tube shaped as an L extends out of the bottom of the top tank, bends at approximately ninety degrees, and extends out of a side surface of the body of the device. The end of the main drain tube has an external male fitting that allows a shut off valve to attach. By turning the shut off valve, the water in the top tank expels from the device. In addition, the other end of the shutoff valve has a female end fitting such that a cap may be attached to further seal the main drain tube, or a hose may be attached to drain the water away from the site where the device is setup.

As the faucet gets turned on, a water pump activates, pushing the clean water through a water pump tubing and out of the faucet. The water then drains through the drain hole of the sink basin of the top surface and into the bottom tank. The pipe that connects the drain hole of the sink basin to the bottom tank passes through the top tank but is sealed as to not allow any mixing of the water between the two tanks. The bottom tank stores the dirty water that results from using the clean water to wash the hands of the user. To drain the bottom tank, a main drain tube shaped as an L extends out of the bottom of the bottom tank, bends at approximately ninety degrees, and extends out of a side surface of the body of the device. The end of the main drain tube has an external male fitting that allows a shut off valve to attach. By turning the shut off valve, the water in the bottom tank expels from the device. In addition, the other end of the shutoff valve has a female end fitting such that a cap may be attached to further seal the main drain tube, or a hose may be attached to drain the water away from the site where the device is setup.

A control panel is preferably attached to a side surface of the body of the device. The control panel has at least one button that controls the components of the device. In one potential embodiment, the control panel may be comprised of only a singular button that, when switched on, powers all components of the device. In another potential embodiment, the control panel may be comprised of multiple buttons and each button powers only a singular component of the device. To inflate the device, an air pump may be turned on by pressing a button on the control panel. In one potential embodiment, a control switch either on the control panel or on the air pump itself may be toggled to force air into the device, causing it to inflate, or to force air out of the device, causing it to deflate. The water pump that pushes water through the faucet of the device may also be controlled using a button on the control panel. Further, lights may be used to communicate to the user when a certain device is toggled on. The control panel and all electrical components of the system may be powered by a battery.

The external male fitting of the top surface of the device is typically closed off with a cap to prevent any materials from contaminating the clean water inside the top tank. To input water into the device, one end of a hose with female fittings on both ends may attach to the external male fitting of the top surface. The other end of the hose may attach to the male fitting of a water container. In one potential embodiment, tubing may connect the external male fitting of the top surface of the device to the water pump such that the water in the water container may be pumped into the top tank. In another potential embodiment, the device may require the water container to be lifted into the air by a user to allow gravity to push the water from the water container and into the top tank. A carrying bag may help to transport the various components of the device. Once the body of the device is deflated and folded, the device may fit easily into the carrying bag, providing a convenient way to transport and store the device.

Accordingly, the inflatable sink device of the present invention is particularly advantageous as it provides the functionality and practicality of a sink in a place where a traditional bathroom sink may be inaccessible. Further, the device can inflate or deflate with air, allowing it to grow when in use, or shrink to be compactly folded providing means for simple storage and transportation. In addition, the device may separate the clean water that gets input into the device from the dirty water that results from washing to ensure washing is completely with clean, fresh water. Therefore, the device eliminates the need for a traditional bathroom sink when there is not a traditional bathroom sink present.

Referring initially to the drawings, FIG. 1 illustrates a perspective view of one potential embodiment of an inflatable sink device 100 of the present invention in accordance with the disclosed architecture. The present invention relates to an inflatable sink device 100. The device 100 is primarily comprised of a body 110, further primarily comprised of a top tank 140, a bottom tank 150, a sink basin 124, an air pump 160, a battery 170, a water pump 180, and a faucet 190. In differing embodiments, the body 110 may have the appearance of a plurality of differing types of sinks, such as, but not limited to: a single basin sink, a double basin sink, a low divider double basin sink, a corner sink, a drainboard sink, twin sinks, etc. Further, the body 110 may be made of a plurality of rubber materials such as natural rubber, styrene-butadiene rubber, butyl, nitrile, neoprene, ethylene propylene diene monomer, silicone, viton, polyurethane, hydrogenated nitrile, etc. The body may also be made of a flexible or semi-flexible plastic material such as, but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc. In addition, the body 110 may be transparent, semi-transparent, or opaque in differing embodiments. Furthermore, the side surfaces 114, bottom surface 118, top surface 120, or any other surface of the body 110 may be comprised of any number of indicia 112 in the form of patterns, logos, emblems, images, symbols, designs, letters, words, characters, animals, advertisements, brands, etc.

In the preferred embodiment, the body 110 of the device 100 is in the form of a generally rectangular single-basin sink comprised of four side surfaces 114, a bottom surface 118, and a top surface 120. A paper towel holder 116 may be fixedly attached to a side surface 114 of the body 110. The paper towel holder 116 may be made of the same material as the body 110 and be comprised of two protrusions that compress a paper towel roll in place while still allowing the paper towel roll to rotate about the central axis of the roll. The bottom surface 118 of the body 110 may be made of the same material as the body 110 or it may be made from a differing, more rigid material (ex. rigid plastic), allowing the device 100 to better retain its position and generate more grip with the ground or other surface on which it is placed.

The top surface 120 of the body 110 is further comprised of at least one storage opening 122, at least one sink basin 124 with at least one drain hole 126, and at least one external male fitting 128 with a cap 129. The storage openings 122 may be used to hold objects 10 commonly used with sinks, such as a sponge, a soap dispenser, a bar of soap, dishwashing liquid, or any other item that may be of convenience for the user. The top surface is also comprised of a faucet 190 and shutoff valve 192 that, when turned, allows water to flow from the faucet 190 and into the sink basin 124. The sink basin 124 collects the water flowing from the faucet 190 and slopes downwards to the drain hole 126 at the bottom of the sink basin 124 from which water dispels. The external male fitting 128 allows a hose 200 with a female fitting 202 to attach to the device 100 such that the device 100 may be filled with water. Once the device 100 has been filled with water, the hose 200 may be detached, at which point the cap 129 may be re-attached to the external male fitting 128 to prevent water from leaking from the device 100 and to prevent other materials from entering the device 100.

Figure 2:
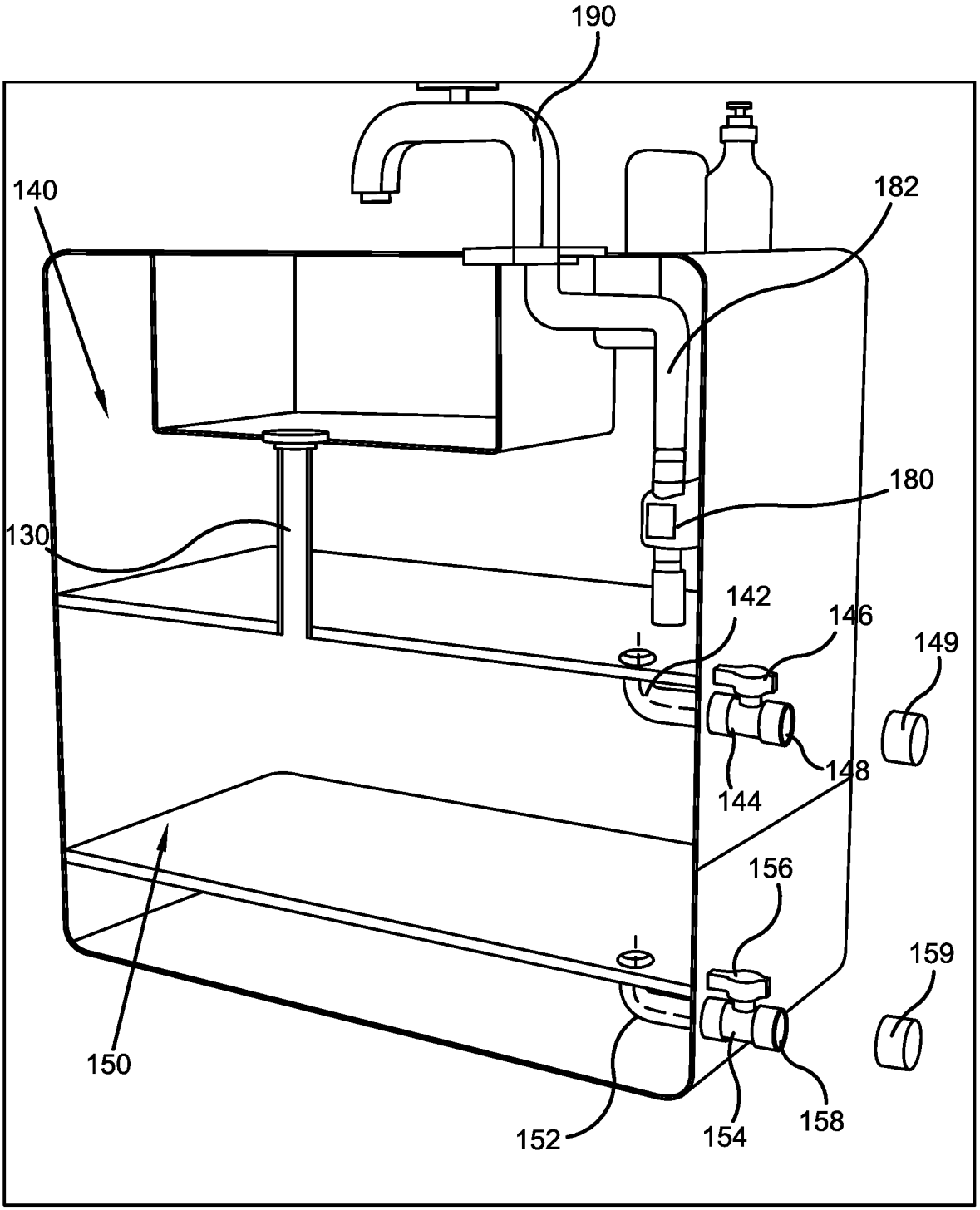
FIG. 2 illustrates a cross-sectional view of one potential embodiment of an inflatable sink device of the present invention in accordance with the disclosed architecture.

FIG. 2 illustrates a cross-sectional view of one potential embodiment of an inflatable sink device 100 of the present invention in accordance with the disclosed architecture. The device 100 is further comprised of two storage tanks, a top tank 140 and a bottom tank 150. The top tank 140 holds clean water that enters the device 100 from the external male fitting 128 on the top surface 120 of the body 110. The clean water in the top tank 140 may be used by a user for handwashing, dishwashing, or any other purpose as seen fit by the user. The top tank 140 is comprised of a main drain tube 142 that is further comprised of an external male fitting 144, that has a shutoff valve 146 and a female end 148 that may receive a male hose. To drain the top tank 140, the shutoff valve 146 can be turned to an open position to allow gravity to expel water through the generally L-shaped main drain tube 142 from the bottom of the top tank 140. A hose may be attached to the other end of the shutoff valve 146, allowing water to drain away from the site where the device 100 is set up. In addition, when the shutoff valve 146 is preventing water flow, a cap 149 may be attached to the female end 148 of the shutoff valve 146 to further seal the main drain tube 142 and prevent water leakage.

Figure 3:
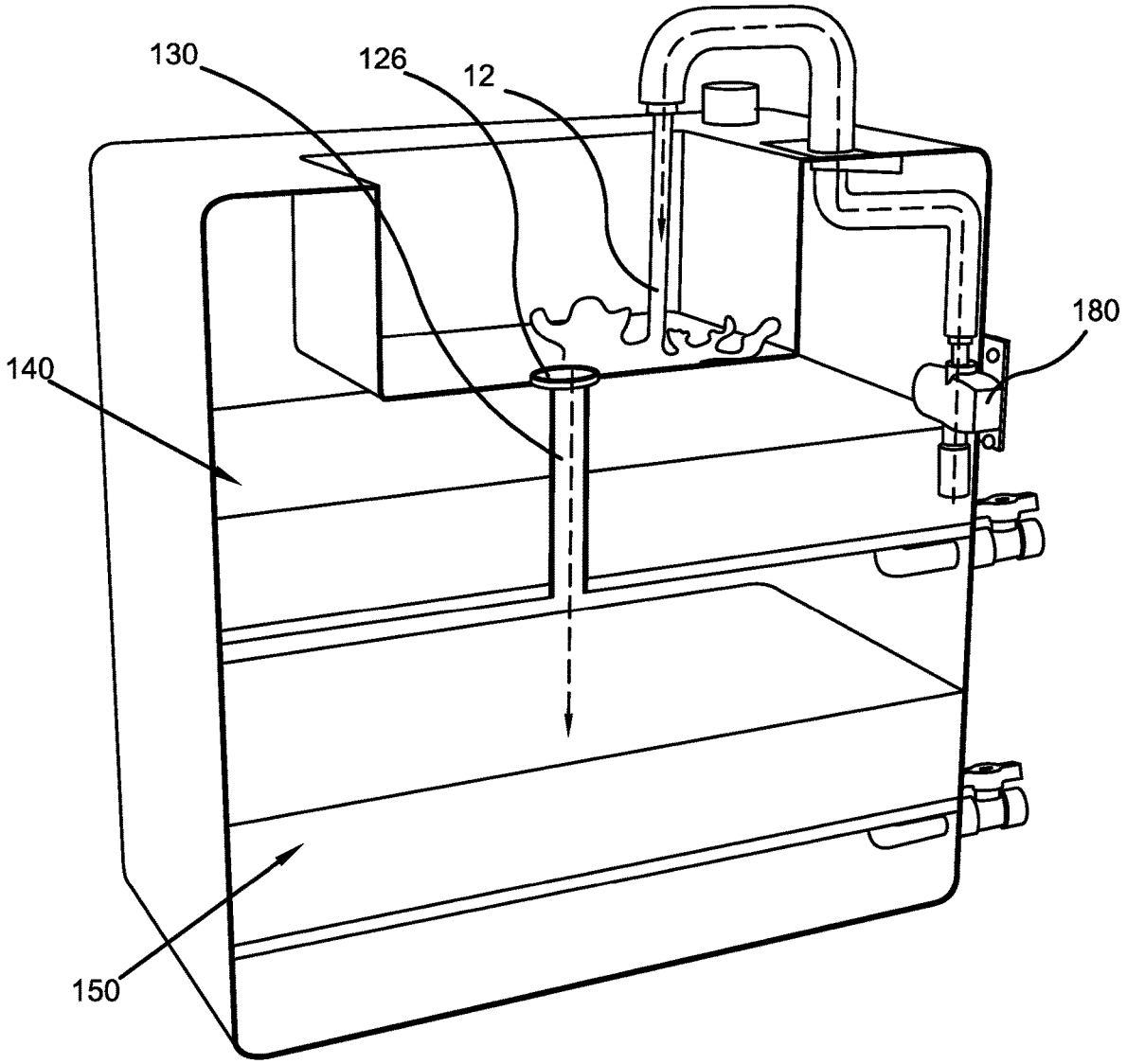
FIG. 3 illustrates a cross-sectional view of one potential embodiment of an inflatable sink device of the present invention in accordance with the disclosed architecture.

FIG. 3 illustrates a cross-sectional view of one potential embodiment of an inflatable sink device 100 of the present invention in accordance with the disclosed architecture. As the shutoff valve 192 of the faucet 190 is in an open position, a water pump 180 pushes the clean water through a water pump tubing 182 and out of the faucet 190 from the top tank 140. The water then drains through the drain hole 126 of the sink basin 124 of the top surface 120 and into a main drain tube 130. The main drain tube 130 passes through the top tank 140 and is sealed to prevent any cross-contamination of the liquids present in the top tank 140 and the main drain tube 130. The main drain tube 130 drains into the bottom tank 150 where the dirty water, resulting from washing hands or other objects, is collected. The bottom tank 150 is comprised of a main drain tube 152 that is further comprised of an external male fitting 154 with a shutoff valve 156 and a female end 158 that can receive a male hose (as best seen in FIG. 2). To drain the bottom tank 150, the shutoff valve 156 can be turned to an open position to allow gravity to expel water through the generally L-shaped main drain tube 152 from the bottom of the bottom tank 140. A hose may be attached to the other end of the shutoff valve 156, allowing water to drain away from the site where the device 100 is set up. In addition, when the shutoff valve 156 is preventing water flow, a cap 159 may be attached to the female end 158 of the shutoff valve 156 to further seal the main drain tube 152 and prevent water leakage.

The water pump 180, as well as any other electrical components of the device 100, may be operated by a control panel 184. The control panel 184 is preferably attached to one of the side surfaces 114 of the body 110 on the exterior of the body 110. At least one button 186 may be present on the control panel to operate the device 100. In one embodiment, a singular button 186 on the control panel 184 may turn all electrical components of the device 100 on. In another embodiment, there may be a button 186 on the control panel 184 for every individual electrical component in the device 100. To inflate the device 100, an air pump 160 may be activated by pressing a button 186 on the control panel 184. The air pump 160 may have multiple buttons 186 on the control panel 184 that allow for the intake of air to inflate the device 100 and for the expulsion of air to deflate the device 100. Both the air pump 160 and the water pump 180, as well as the control panel 184, are powered by a battery 170. The battery 170 may be a disposable battery or a rechargeable battery in the form of an alkaline, nickel-cadmium, nickel-metal hydride battery, etc., such as any 3V-12 volts DC battery or other conventional battery such as A, AA, AAA, etc. that supply power to the device 100. Throughout this specification the term "battery" 170 may be used interchangeably to refer to one or more wet or dry cells or batteries of cells in which chemical energy is converted into electricity and used as a source of DC power. References to recharging or replacing the battery 170 may refer to recharging or replacing individual cells, individual batteries of cells, or a package of multiple battery cells as is appropriate for any given battery technology that may be used.

Figure 4:
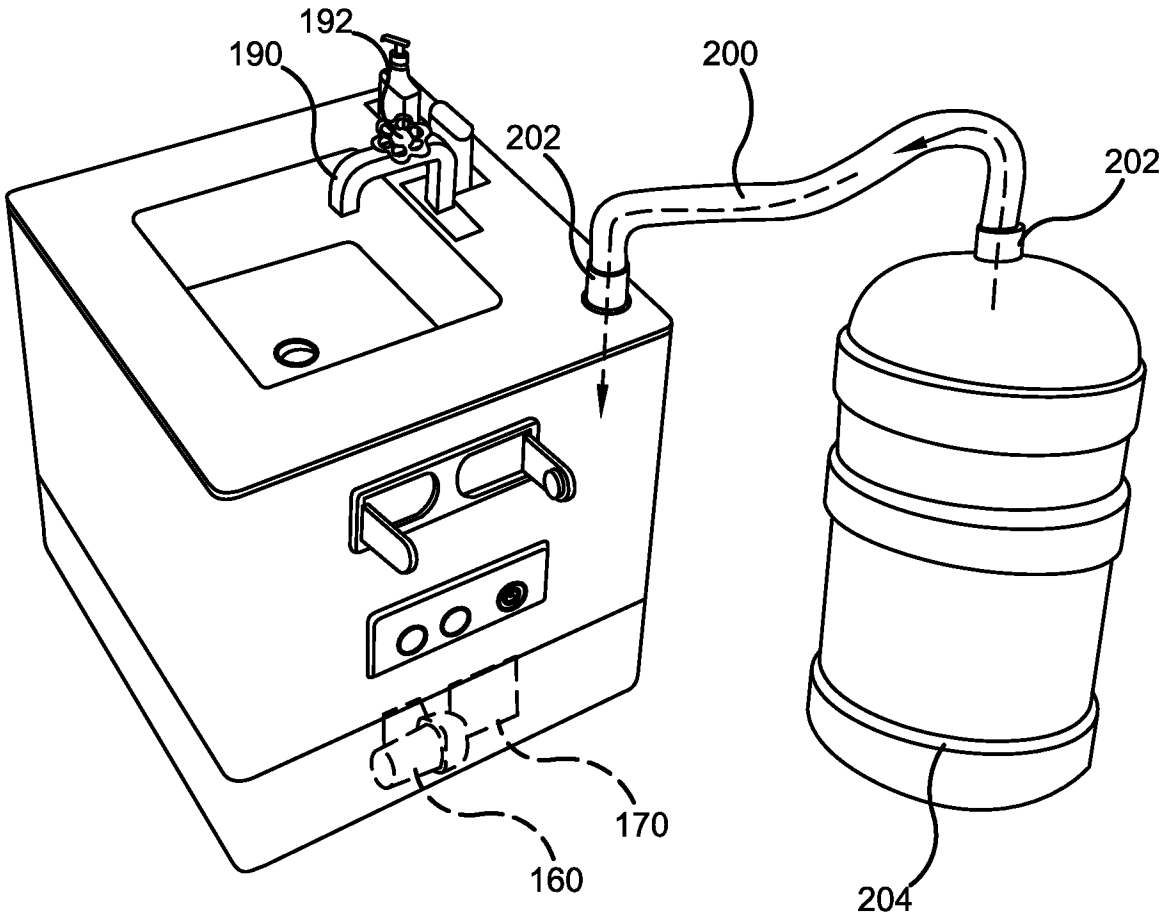
FIG. 4 illustrates a perspective view of one potential embodiment of an inflatable sink device of the present invention in accordance with the disclosed architecture.
Figure 5:
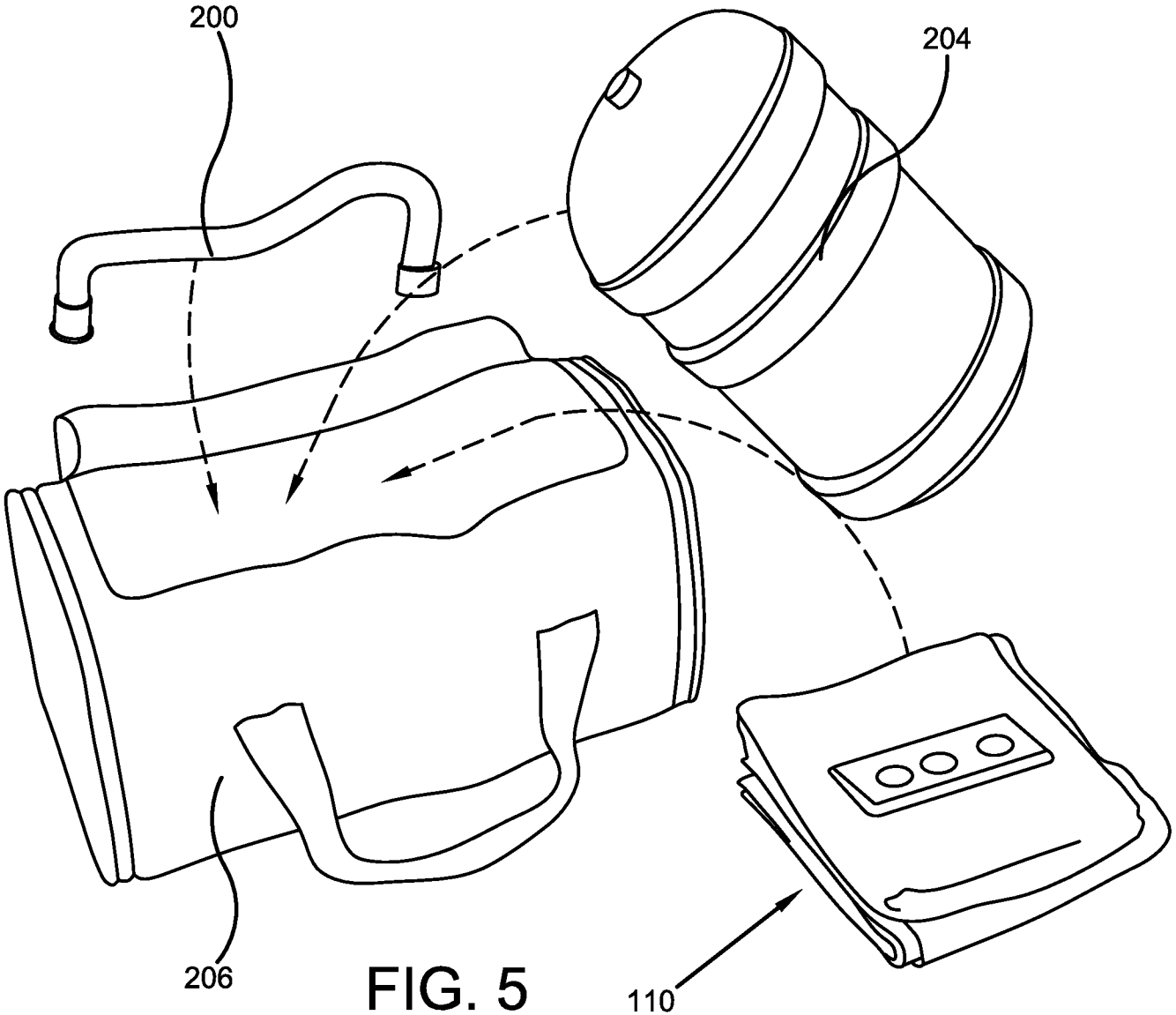
FIG. 5 illustrates a perspective view of one potential embodiment of an inflatable sink device of the present invention while deflated in accordance with the disclosed architecture.

FIG. 4 illustrates a perspective view of one potential embodiment of an inflatable sink device 100 of the present invention in accordance with the disclosed architecture. To input water into the device 100, one end of a hose 200 with a female fitting 202 of each hose end attaches to the external male fitting 128 on the top surface 120 of the body 110 of the device 100. The other end of the hose 200 may attach to the male fitting of a water container 204 which may then be picked up to dump water into the top tank 140 of the device 100. In one potential embodiment, the water pump tubing 182 may also be integrated into the external male fitting 128 of the top surface 120 such that the pressure generated from the water pump 180 pulls the water from the water container 204 and into the top tank 140 of the device 100 without having to lift the water container 204 off the ground. To easily store and transport all components of the device 100, the components may easily fit into a carrying bag 206 (as best seen in FIG. 5). By using the air pump 160 to deflate the body 110 of the device 100, the body 110 may be folded compactly to easily fit into the carrying bag 206 with the water container 204 and hose 200.

In a further embodiment of the present invention, the inflatable sink device 100 may further comprise one or more Bluetooth or wireless speakers 208 that may be paired to a smart device such as, but not limited to, a smartphone, computer, smartwatch, tablet, etc. In this manner, the user can also play audio through the inflatable sink device 100 as desired. The Bluetooth or wireless speakers 208 may be powered by the battery 170.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "inflatable sink device" and "device" are interchangeable and refer to the inflatable sink device 100 of the present invention.

Notwithstanding the forgoing, the inflatable sink device 100 of the present invention and its various components can be of any suitable size and configuration as is known in the art without affecting the overall concept of the invention, provided that they accomplish the above-stated objectives. One of ordinary skill in the art will appreciate that the size, configuration and material of the inflatable sink device 100 as shown in the FIGS. are for illustrative purposes only, and that many other sizes and shapes of the inflatable sink device 100 are well within the scope of the present disclosure. Although the dimensions of the inflatable sink device 100 are important design parameters for user convenience, the inflatable sink device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An inflatable sink device comprising:
- a top surface;
- a sink basin;
- an external male fitting;
- a drain hole connected to a main drain tube;
- a top tank comprised of a main drain tube and an external male fitting;
- a bottom tank comprised of a main drain tube and an external male fitting;
- an air pump;
- a battery;
- a water pump;
- a control panel; and
- a faucet, wherein the inflatable sink device can be inflated and deflated by the air pump.

2. The inflatable sink device of claim 1, wherein the water pump transports a quantity of water from the top tank to the faucet and into the sink basin.

3. The inflatable sink device of claim 1, wherein the battery supplies power to each of the water pump, the air pump and the control panel.

4. An inflatable sink device comprising:
- a sink basin;
- an external male fitting;
- a drain hole in fluid communication with a main drain tube;
- a top tank comprised of a main drain tube and an external male fitting further comprised of a shutoff valve and a cap;
- a bottom tank further comprised of a main drain tube and an external male fitting further comprised of a shutoff valve and a cap;
- an air pump;
- a water pump;
- a control panel that controls each of the air pump and the water pump;
- a battery;
- a faucet having a shutoff valve;
- a water container;
- a hose with two female fittings; and
- a carrying bag.

5. The inflatable sink device of claim 4, wherein the control panel is further comprised of a button.

6. The inflatable sink device of claim 4, wherein the hose with two female fittings can be attached to each of the external male fitting of the top tank and the water container.

7. The inflatable sink device of claim 4, wherein the water pump is located within the top tank.

8. The inflatable sink device of claim 4, wherein the main drain tube connected to the drain hole passes through the top tank and into the bottom tank.

9. The inflatable sink device of claim 4, wherein the external male fitting of the bottom tank allows water to drain from the bottom tank.

10. The inflatable sink device of claim 4, wherein the external male fitting of the top tank allows water to drain from the top tank.

11. The inflatable sink device of claim 4 further comprising a top surface having a storage opening.

12. The inflatable sink device of claim 4, wherein the sink basin slopes downward towards the drain hole.

13. The inflatable sink device of claim 4 further comprised of a paper towel holder.

14. The inflatable sink device of claim 13, wherein the paper towel holder is manufactured from a rigid plastic.

15. The inflatable sink device of claim 4, wherein a bottom surface of the inflatable sink device is made from a rigid plastic material.

16. The inflatable sink device of claim 4, wherein the control panel is located on an exterior side surface of the inflatable sink device.

* * * * *